US011096471B2

(12) United States Patent
White, Jr.

(10) Patent No.: US 11,096,471 B2
(45) Date of Patent: Aug. 24, 2021

(54) CARRYING DEVICE

(71) Applicant: LeRoy White, Jr., Los Angeles, CA (US)

(72) Inventor: LeRoy White, Jr., Los Angeles, CA (US)

( * ) Notice: Subject to any disclaimer, the term of this patent is extended or adjusted under 35 U.S.C. 154(b) by 0 days.

(21) Appl. No.: 15/929,433

(22) Filed: May 1, 2020

(65) Prior Publication Data

US 2020/0253359 A1 Aug. 13, 2020

Related U.S. Application Data

(62) Division of application No. 16/236,838, filed on Dec. 31, 2018, now abandoned.

(51) Int. Cl.
*A45F 3/14* (2006.01)
*A63C 17/00* (2006.01)

(52) U.S. Cl.
CPC ..... *A45F 3/14* (2013.01); *A63C 17/0006* (2013.01); *A45F 2003/142* (2013.01); *A63C 2203/44* (2013.01)

(58) Field of Classification Search
CPC ..... A45F 3/14; A45F 3/04; A45F 2003/146; A45F 2003/142; A45F 3/02; A45F 5/12; A45C 13/30; A45C 7/0086; A45C 2203/44; A45C 17/0006; A63C 11/025; B65G 7/12; Y10S 224/917
USPC ..... 224/250, 578–580, 917, 651, 584; 294/141, 148–150, 154, 157; 248/693
See application file for complete search history.

(56) References Cited

U.S. PATENT DOCUMENTS 4,867,359 A * 9/1989 Donovan ..... A43B 5/0425 224/602
5,579,966 A * 12/1996 Krumweide ..... A45F 3/08 224/259
D406,942 S * 3/1999 Santoro ..... D3/216
6,347,730 B1 * 2/2002 Frederick ..... A45F 3/14 224/250
6,427,886 B1 * 8/2002 Essex ..... A45F 3/14 224/250
8,844,991 B2 * 9/2014 Myers ..... B65G 7/12 294/157
D760,653 S * 7/2016 Lorino ..... D13/119
2016/0100671 A1 * 4/2016 Zets ..... A45F 3/02 224/250

* cited by examiner

*Primary Examiner* — Adam J Waggenspack
(74) *Attorney, Agent, or Firm* — Dunlap Bennett & Ludwig, PLLC

(57) ABSTRACT

A device that secures an object to the user's body, hands free, while carrying multiple types of bulky items is provided. The carrying device may include at least a pair of first straps and a second strap having a plurality of loops spaced apart along its length. Each strap terminates at opposing ends providing complementary and adjustable connectors, so that when each of the two first straps selectively engages one loop of the plurality the loops, many different types of bulky items may be secured to the body of user when the connectors are locked, thereby leaving the user hands free while transporting bulky objects.

9 Claims, 3 Drawing Sheets

CARRYING DEVICE

CROSS-REFERENCE TO RELATED APPLICATION

This application claims the benefit of priority of U.S. non-provisional application Ser. No. 16/236,838, filed 31 Dec. 2018, as a divisional thereof, the contents of which are herein incorporated by reference.

BACKGROUND OF THE INVENTION

The present invention relates to carrying devices and, more particularly, a carrying device that secures an object to the user's body, hands free, while carrying multiple types of bulky items.

Current carrying device for transporting bulky items are themselves bulky and hard to store. Furthermore, current bulky-item carrying devices are limited to the types of bulky items that they can reasonably carry as such carrying devices tend to be tailored to carry specific odd items.

As can be seen, there is a need for a carrying device that secures an object to the user's body, hands free, while carrying multiple types of bulky items. The carrying device embodied in the present invention is adaptable to carry innumerable bulky objects in multiple ways, separately and in combination. The present invention enables users to secure such bulky items against their body or body parts, thereby leaving them hands free when carry such items. Finally, the strap-based structure of the present invention makes the instant carrying device less bulky and easier to store compared to current carrying devices designed to carry bulky items.

SUMMARY OF THE INVENTION

In one aspect of the present invention, a carrying device includes the following: two first straps, each first strap extending between opposing first ends providing first complementary connectors adapted to removable connect and to adjust the length of each first strap; a second strap extending between opposing second ends providing second complementary connectors adapted to removable connect and to adjust the length of the second strap; each first strap joined to the second strap between the respective complementary connectors; and a plurality of loops spaced apart along the second strap. In another aspect of the present invention, the carrying device includes the following: two first straps, each first strap extending between opposing first ends providing first complementary connectors adapted to removable connect and to adjust the length of each first strap; a second strap extending between opposing second ends providing second complementary connectors adapted to removable connect and to adjust the length of the second strap; each first strap joined to the second strap between the respective complementary connectors, wherein three-quarters or more of each first strap is disposed on one side of the second strap and the remainder of each first strap is disposed on the other side of the second strap; and two loops spaced apart along the second strap so that one loop is disposed between different opposing second complementary connectors and an adjacent first strap of the two first straps.

In another aspect of the present invention, a method of carrying bulky objects includes the following steps: providing the carrying device mentioned above; the carrying device adapted so that each of the two first straps and the second straps wrap around a torso of a human user with fifty percent or less slack in each strap; and selectively sliding the two first straps through a respective loop of the plurality of loops so as to secure one or more bulky objects against said torso when removably engaging a majority of the complementary connectors so that only the two first straps wrap around said torso, or wherein only the second strap wraps around said torso.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a device that secures an object to the user's body, hands free, while carrying multiple types of bulky items. The carrying device may include at least a pair of first straps and a second strap having a plurality of loops spaced apart along its length. Each strap terminates at opposing ends providing complementary and adjustable connectors, so that when each of the two first straps selectively engages one loop of the plurality the loops, many different types of bulky items may be secured to the body of user when said connectors are locked, thereby leaving the user hands free while transporting bulky objects.

Figure 1:
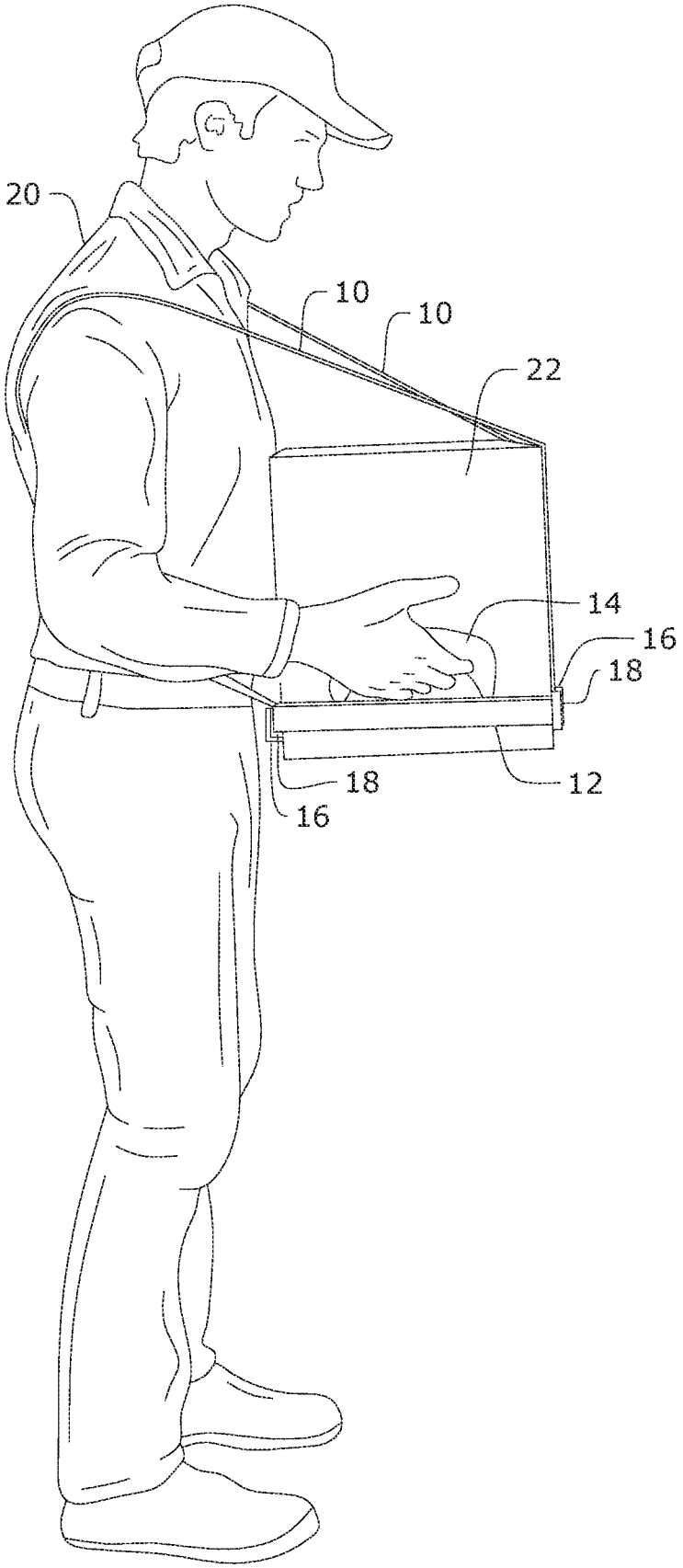
FIG. 1 is a perspective view of an exemplary embodiment of the present invention, shown in use.
Figure 2:
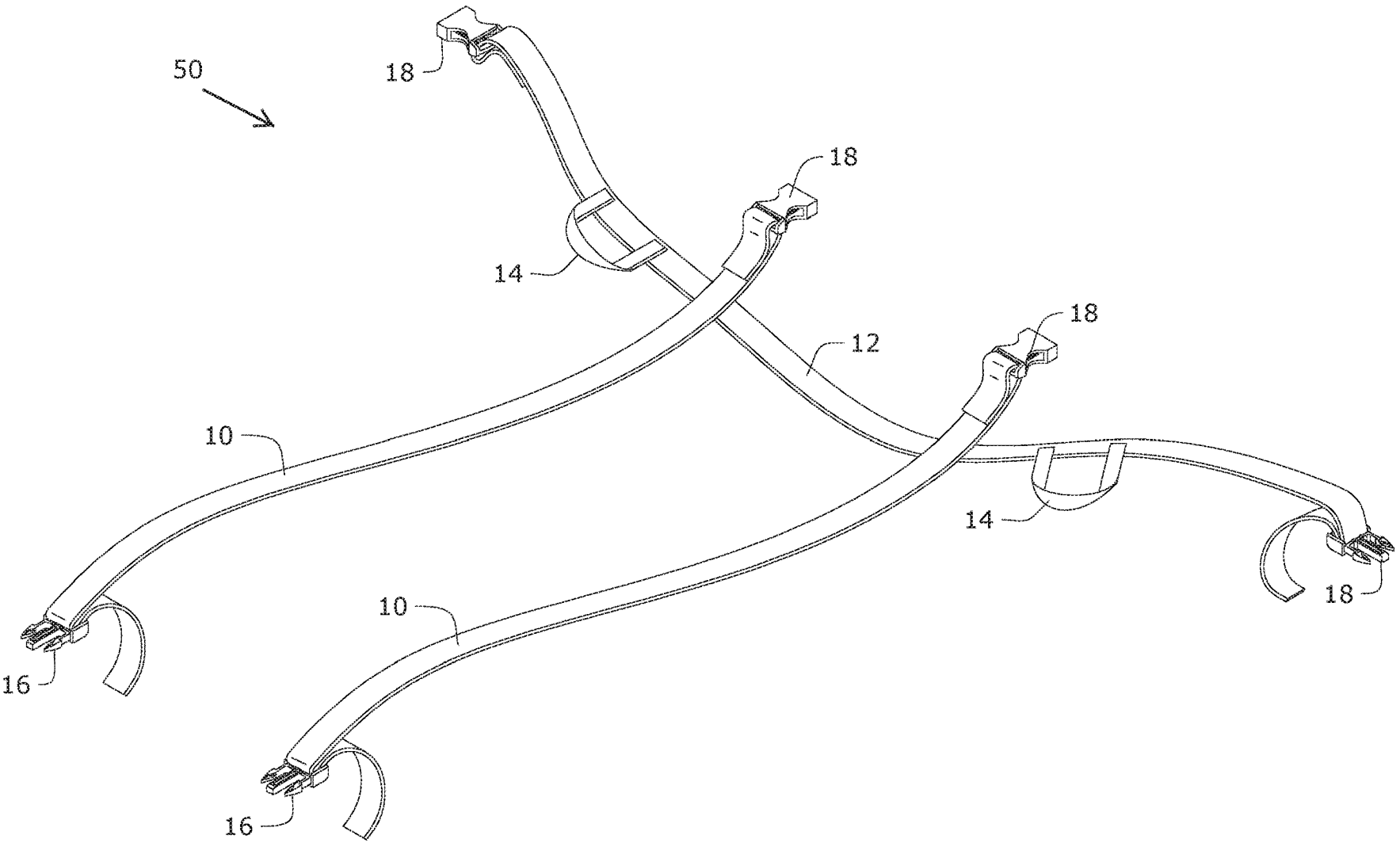
FIG. 2 is a perspective view of an exemplary embodiment of the present invention.
Figure 3:
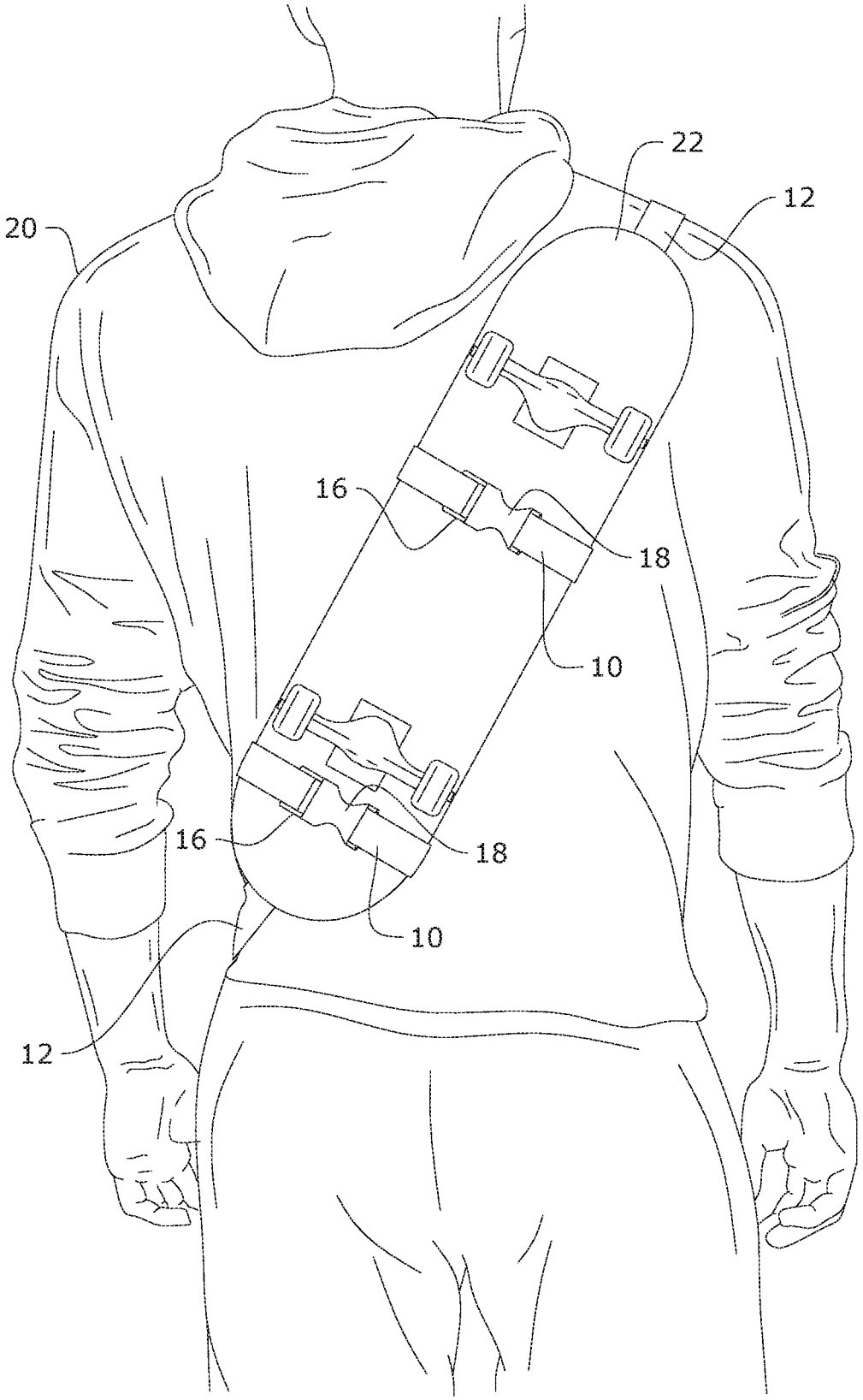
FIG. 3 is a perspective view of an exemplary embodiment of the present invention.

Referring now to FIGS. 1 through 3, the present invention may include a carrying device 50. The carrying device 50 may provide a pair of first straps 10 and a singular second strap 12. Each strap 10 and 12 terminates at opposing ends providing one of a pair of complementary connectors 16 and 18, a male connector 16 and a female connector 18 removably connectable to each other. The complementary connectors 16 and 18 may adjustable and/or enable the lengths of their strap 10 or 12 to be adjustable, enabling the accommodation of innumerable bulky objects 22. Similarly, the complementary connectors 16 and 18 and/or straps 10 and 12 may be adjustable so as to enable a user 20 to adjust a carrying position of the object(s) 22. The complementary connectors 16 and 18 may be complementary buckles or may be any fastener known in the art for fastening or removably securing one object to another including, for example, standard push-button snaps, Velcro-type fasteners, adhesive substances, combinations thereof, and the like. It should also be that the complementary connectors 16 and 18 may be configured in any array and/or number, so long as they function in accordance with the present invention as described herein.

The second strap 12 may provide a plurality of spaced-apart loops 14 along its length. It should be understood that even though only two loops 14 are shown in FIG. 2, the loops 14 may number up to eight or more spaced along the second strap 12. Thereby the adjustable strap 10 and 12 enable the accommodation of innumerable bulky objects 22 through the bulky object(s) 22 being securing by the first straps 10 to the loops 14, and the second strap 12 to the body of the user 22. Each strap 10 and 12 and loop 14 may be made from material that may be repeatedly subject to tension forces in accordance with the present invention as described herein and yet not fail.

A method of using the present invention may include the following. The carrying device 50 disclosed above may be provided. A user 20 may slide one of the pair of first straps 10 selectively through one of the plurality of loops 14 on the second strap 14 so as to secure the object 22 against the body of the user 20 when all complementary connectors 16 and 18 are removably engaged in a locked condition, as illustrated in FIGS. 1 and 3. The first straps 10 may engage the body of the user 20, as illustrated in FIG. 1. In other embodiments, only the second strap 12 may engage the body of the user 20. In either embodiment, the user 20 is left hands free to manipulate other things.

The present invention may also be used to similarly store bulky items, as well as transport them. For example, in one embodiment, the straps 10 and 12 may engage an object 22 to support it against a post or frame (not shown), thereby storing the object to said post or frame for extended periods of time, elevated above a supporting structure, out of the way and away from pests and other articles that may damage the stored object 22.

It should be understood, of course, that the foregoing relates to exemplary embodiments of the invention and that modifications may be made without departing from the spirit and scope of the invention as set forth in the following claims.

What is claimed is:

1. A method of carrying bulky objects, comprising the steps of:

providing a carrying device comprising:

two first straps, each first strap extending between opposing first ends having first complementary connectors adapted to removably connect and to adjust the length of each first strap;

a second strap extending between opposing second ends having second complementary connectors adapted to removably connect and to adjust the length of the second strap;

each first strap joined to the second strap between the respective complementary connectors; and two loops along the second strap and away from a longitudinal edge of the second strap which is a longest edge of the strap, the two loops spaced apart on opposite sides of the two first straps, wherein each loop defines an empty void;

selectively sliding each of the two first straps through the empty void of an adjacent loop of the two loops, respectively, so as to secure one or more bulky objects against a body part of a human user.

2. The method of claim 1, further comprising selectively adjusting the first and the second complementary connectors in such a way that there is fifty percent or less slack in each strap wrapped around said body part.

3. The method of claim 2, further comprising connecting the first and second complementary connectors.

4. The method of claim 1, further comprising wrapping each of the two first straps around said body part.

5. The method of claim 4, further comprising selectively adjusting the first complementary connectors in such a way that there is fifty percent or less slack in each of the two first straps wrapped around said body part.

6. The method of claim 5, further comprising connecting the first complementary connectors.

7. The method of claim 1, further comprising wrapping the second strap around said body part.

8. The method of claim 7, further comprising selectively adjusting the second complementary connectors in such a way that there is fifty percent or less slack in each of the second strap wrapped around said body part.

9. The method of claim 8, further comprising connecting the second complementary connectors.

* * * * *